US006229484B1

(12) United States Patent
Sagisaka

(10) Patent No.: US 6,229,484 B1
(45) Date of Patent: May 8, 2001

(54) DUAL POLARIZED FLAT ANTENNA DEVICE

(75) Inventor: Atsushi Sagisaka, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/348,350

(22) Filed: Jul. 8, 1999

(30) Foreign Application Priority Data

Jul. 10, 1998 (JP) ..... 10-196359

(51) Int. Cl.[7] ..... H01Q 1/38
(52) U.S. Cl. ..... 343/700 MS; 343/770
(58) Field of Search ..... 343/700 MS, 767, 343/770, 756, 826

(56) References Cited

U.S. PATENT DOCUMENTS

| | | | | |
|---|---|---|---|---|
| 4,816,835 | * | 3/1989 | Abiko et al. | 343/700 MS |
| 4,926,189 | * | 5/1990 | Zaghloul et al. | 343/700 MS |
| 4,929,959 | * | 5/1990 | Sorbello et al. | 343/700 MS |
| 5,453,571 | * | 9/1995 | Tsukamoto | 343/700 MS |
| 5,534,877 | * | 7/1996 | Sorbello et al. | 343/700 MS |

FOREIGN PATENT DOCUMENTS 9-51225 2/1997 (JP) .

OTHER PUBLICATIONS

"Characteristics of Dual Polarized Flat Antenna", Katsuya Tsukamoto and Hiroyuki Arai, Transactions of Institute of Electronics and Communication Engineers of Japan, B–II, vol. J79–B–II, No. 8, pp. 476–484, Aug., 1996.

* cited by examiner

*Primary Examiner*—Don Wong
*Assistant Examiner*—Ephrem Alemu
(74) *Attorney, Agent, or Firm*—Finnegan, Henderson, Farabow, Garrett & Dunner, L.L.P.

(57) ABSTRACT

A high efficiency antenna device suited for use in a mobile unit is provided. A pair of triplate antennas are stacked, in which a lower antenna includes a feeding probe for a horizontal polarization and an upper antenna includes a feeding probe for a vertical polarization. The feeding probes have patch edges at opposing ends in the polarization direction. A coupling slot for coupling the upper and lower antennas are disposed over the patch edges in the lower antenna. In-phase magnetic current runs through the patch edges, so that a phase match is obtained between the two slots, raising antenna efficiency. The feeding probe is disposed at an angle and oriented in a direction corresponding to a representative value of polarization angels of the traveling area, to thereby reducing polarization angle loss as a whole. In an array antenna extending in a transverse direction, the propagating direction of parallel plate mode waves at the lower antenna is matched with the longer side of the array, so that the parallel plate mode can be efficiently utilized.

10 Claims, 9 Drawing Sheets

STRENGTH OF PARALLEL PLATE MODE WAVES (LOWER ANTENNA)

DUAL POLARIZED FLAT ANTENNA DEVICE

BACKGROUND OF THE INVENTION

1. Field of the Invention

The present invention relates to a dual polarized flat antenna device including multi-layered flat antennas such as triplate antennas, and more particularly to such a device wherein transmission and reception efficiency are improved. The present invention is suitably applied to an antenna device used for a mobile unit or the like.

2. Description of the Related Art

FIGS. 1 and 2 show the structure of an antenna device disclosed in "Characteristics of Dual Polarized Flat Antenna" (Katsuya Tsukamoto, et al., Transactions of Institute of Electronics and Communication Engineers of Japan, B-II, Vol. J79-B-II, No. 8, pp. 476–484, August, 1996). According to that publication, an antenna 1 is formed by two triplate antennas 2 and 3 stacked in an orthogonal direction. The lower antenna 2 receives a horizontal polarization while the upper antenna 3 receives a vertical polarization.

The antenna 1 includes stacked layers of a lower ground plate 4, a horizontal polarization feeding circuit plate (board) 5, a middle ground plate 6 (radiation circuit plate for a horizontal polarization), a vertical polarization feeding circuit plate 7, and an upper ground plate 8 (radiation circuit plate). The respective layers are isolated by a dielectric layer with a low dielectric constant interposed therebetween. The feeding circuit plates (boards) 5 and 7 have feeding probes 5*a* and 7*a,* and feeder lines 5*b* and 7*b,* respectively. The horizontal feeding probe 5*a* and the vertical feeding probe 7*a* are provided orthogonal to each other.

The middle ground plate 6 includes twin coupling slots 6*a* serving as radiation elements for each antenna element. As shown in FIGS. 2A and 2C, the longer side of the slot 6*a* is orthogonal to the horizontal feeding probe 5*a* in order to gain electromagnetic coupling of the horizontal feeding probe 5*a* in the lower antenna.

On the other hand, as shown in FIGS. 2A and 2B, the feeding probe 7*a* of the upper antenna 3 is parallel to the longer side of the slot 6*a,* and a metal portion is disposed on the bottom side of the feeding probe 7*a.* As the middle plate 6 functions as a ground plate, the electromagnetic coupling at the upper antenna 3 can be ignored.

The upper ground plate 8 includes a plurality of radiation windows 8*a* disposed corresponding to the antenna array. The radiation windows 8*a* are square aperture elements for receiving a vertical polarization and for transmitting a horizontal polarization to the lower antenna 2.

The middle and upper ground plates 6 and 8 serving as radiation circuit plates are formed from metal or printed plates. The middle ground plate 6 functions as a radiation circuit for the lower antenna 2 and as a ground plate for the upper antenna 3, thereby contributing to a reduction in the number of layers required.

However, as discussed in more detail below, further improvement in efficiency is desired for the above-described dual polarized flat antenna device. Especially when the antenna is mounted on a mobile unit, reduction in height is strongly desired, while maximum performance is required in a wide range of locations. Therefore, a need exists for a high efficiency antenna that can meet such demands.

In a conventional antenna, phases at the twin coupling slots 6*a* (slot pair) of each antenna element are not matched on principle, leading to the possibility of introduction of error in the reception direction. Although the phases at the slot pair can be matched if spacing between slots exceeds one wavelength, it is impractical to implement such a spacing on the antenna array. Consequently, an individual antenna element has a disadvantageously low antenna efficiency. The antenna shown in FIGS. 1 and 2 overcomes effects of the phase mismatch by cancellation between the multitude of antenna elements. However, when an antenna consisting of a small number of elements, such as an antenna for a moving vehicle, is desired, the above cancellation effects may not be expected. Therefore, improvement in performance of a single element is desired in order to achieve a high antenna efficiency even in such an application as described above.

In addition, a conventional antenna device has a further disadvantage of polarization angle loss when mounted on a mobile unit, such as a motor vehicle. Considering CS broadcast as an example, a horizontal polarization is inclined with respect to the horizon due to the difference in latitude between a transmitting station (satellite) and a receiving station (vehicle), and the same occurs with the vertical polarization. This inclination is the polarization angle. Although there is no need to consider the polarization angle for conventional BS broadcast, in CS broadcast noise is increased due to effects of the polarization angle. If the receiving station is fixed, the direction of the antenna can be set in the beginning so as to avoid the polarization angle loss because the polarization angle remains unchanged. However, mobile units require other techniques for reducing the polarization angle loss because the polarization angle changes with the location.

A conventional antenna device has still another disadvantage because parallel plate mode radiation, electromagnetic waves that propagate between ground plates without contributing to radiation, make it difficult to reduce the height of the antenna as desired. While it is well known to efficiently utilize parallel plate mode waves by arranging antenna elements with an appropriate spacing so that the waves are radiated from other antenna elements. However, in order to reduce antenna height, the number of elements arranged in the height direction must be reduced. Thus, it is desirable to provide an antenna that allows reduction in the number of elements in the height direction while maintaining efficient use of the parallel plate mode.

SUMMARY OF THE INVENTION

An object of the present invention is to provide a dual polarized flat antenna device with a high efficiency. While the present invention solves the above-described problems of the antenna for mobile units, its application is not limited to use in such mobile units.

(1) The present invention relates to a dual polarized flat antenna device including at least one antenna element formed by stacking flat antennas for polarizations in different directions. To achieve the above object, the flat antenna is provided with a patch type feeding probe having patch edges at the opposing ends in the polarization direction. A coupling slot for coupling a lower flat antenna with an upper antenna is disposed over said patch edges at the opposing ends of the feeding probe in the lower antenna.

According to the present invention, electromagnetic waves propagate through the coupling slot, to be received by the patch edges at the opposing ends of the probe. This process is reversed for transmission, as is possible also with all processes described below. In-phase magnetic current is generated in the patch edges at the opposing ends, to thereby match the radiation waves in phase at the opposing edges, i.e. opposing slots. As a result, efficiency of a single antenna element can be improved.

(2) In one aspect of the present invention, the feeding probe of the flat antenna is disposed to face the direction corresponding to a representative value of polarization angles in a traveling area of a mobile unit. According to the present invention, polarization angle loss can be reduced as a whole by directing the probe in accordance with the representative value of polarization angles.

Preferably, the coupling slot for coupling the lower flat antenna with the upper antenna may be disposed to be inclined corresponding to the angle at which the feeding probe is disposed. Such disposition can avoid generation of a cross polarization component resulting from deviation in direction of the probe and the coupling slot.

It may also be preferable for a plurality of antenna elements to be arranged such that they form an element array, and for an upper ground plate to be disposed having a group of radiation windows aligned in a lattice pattern corresponding to the element array. Although in this aspect the feeding probe is inclined, the radiation windows are arranged in a lattice pattern and aligned in a non-inclined manner. Thus, space between the radiation windows is secured for wiring, thereby enhancing the degree of wiring freedom.

(3) In another aspect of the present invention, a plurality of antenna elements are arranged to form an elongated element array. The extending direction of the element array coincides with the propagating direction of parallel plate mode waves at the lower antenna. The antenna device may be constructed for mobile units, and the element array extends in a transverse direction, i.e. the extending direction of the element array is horizontal. The lower antenna is used for a horizontal polarization.

According to the present invention, an elongate element array (which is rectangular or ellipse in shape, for example) can be formed while maintaining a high antenna efficiency, as described below. Waves in the parallel plate mode have a easily-propagating direction and a hardly-propagating direction. In, for example, a feeding probe of a patch type the parallel plate mode waves mainly propagate in a feeding direction. According to the present invention, the propagating direction of the parallel plate mode waves in the lower antenna is matched with the extending direction of the array. As a result, the parallel plate mode waves in the lower antenna are efficiently used by utilizing a group of antenna elements arranged in the extending direction of the array. By thus securing an efficient use of the parallel plate mode in the lower antenna that tends to confine waves to radiate as the parallel plate mode, allowing a sufficient antenna efficiency to be achieved even in an element array that is rectangular or ellipse in shape. Consequently, an elongated arrangement extending in a transverse or longitudinal direction is made possible, and a transversely extending antenna allows reduction in height.

An antenna element of the present invention is formed by, for example, stacking triplate antennas as said flat antennas. It should be noted that the flat antenna is not limited to a triplate antenna, and that an antenna element may also be formed by stacking a microstrip antenna on a triplate antenna. It will be appreciated by those skilled in the art that the antenna device of the present invention can be used for either or both of transmission and reception.

DESCRIPTION OF THE PREFERRED EMBODIMENT

Figure 1:
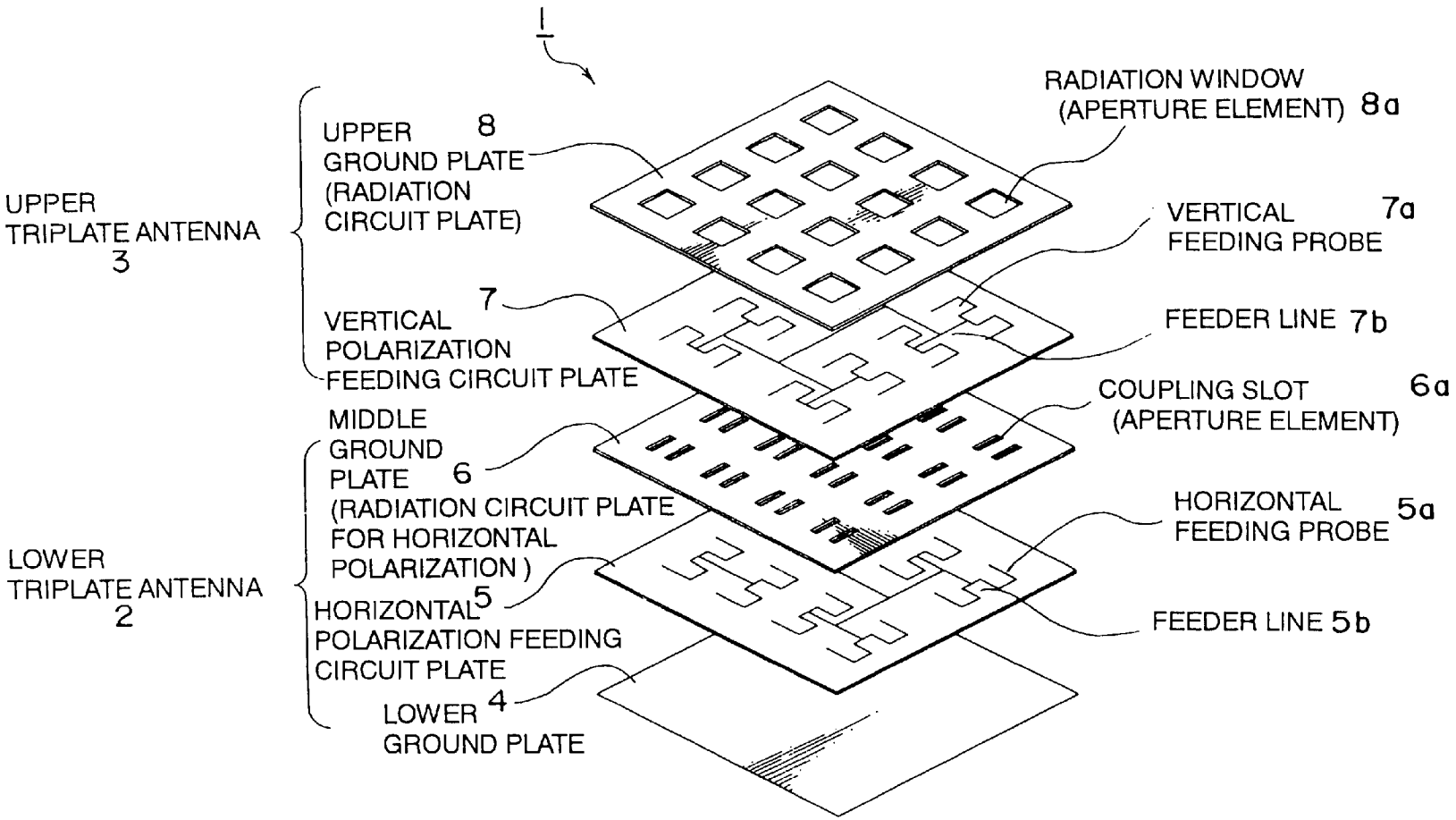
Fig. 1 PRIOR ART
FIG. 1 shows a structure of a conventional dual polarized flat antenna device.
Figure 2:
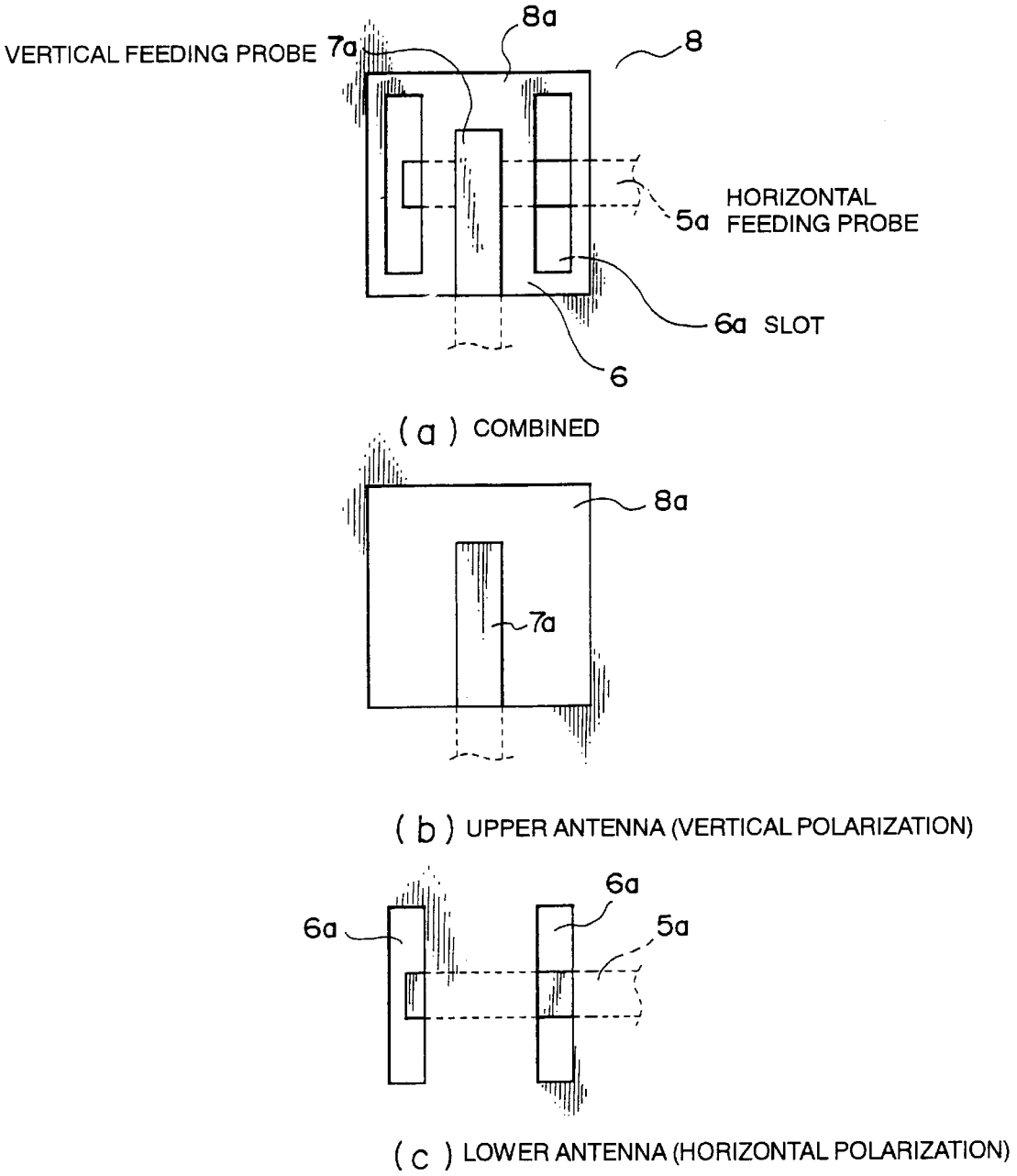
Fig. 2 PRIOR ART
FIGS. 2A–2C are top views of an antenna element shown in FIG. 1.

A preferred embodiment of the present invention is described in the following with reference to the attached drawings and using a receiving antenna as an example for ease of explanation and understanding. The matters discussed above with reference to FIGS. 1 and 2 will not be described again.

"Antenna Element"

Figure 3:
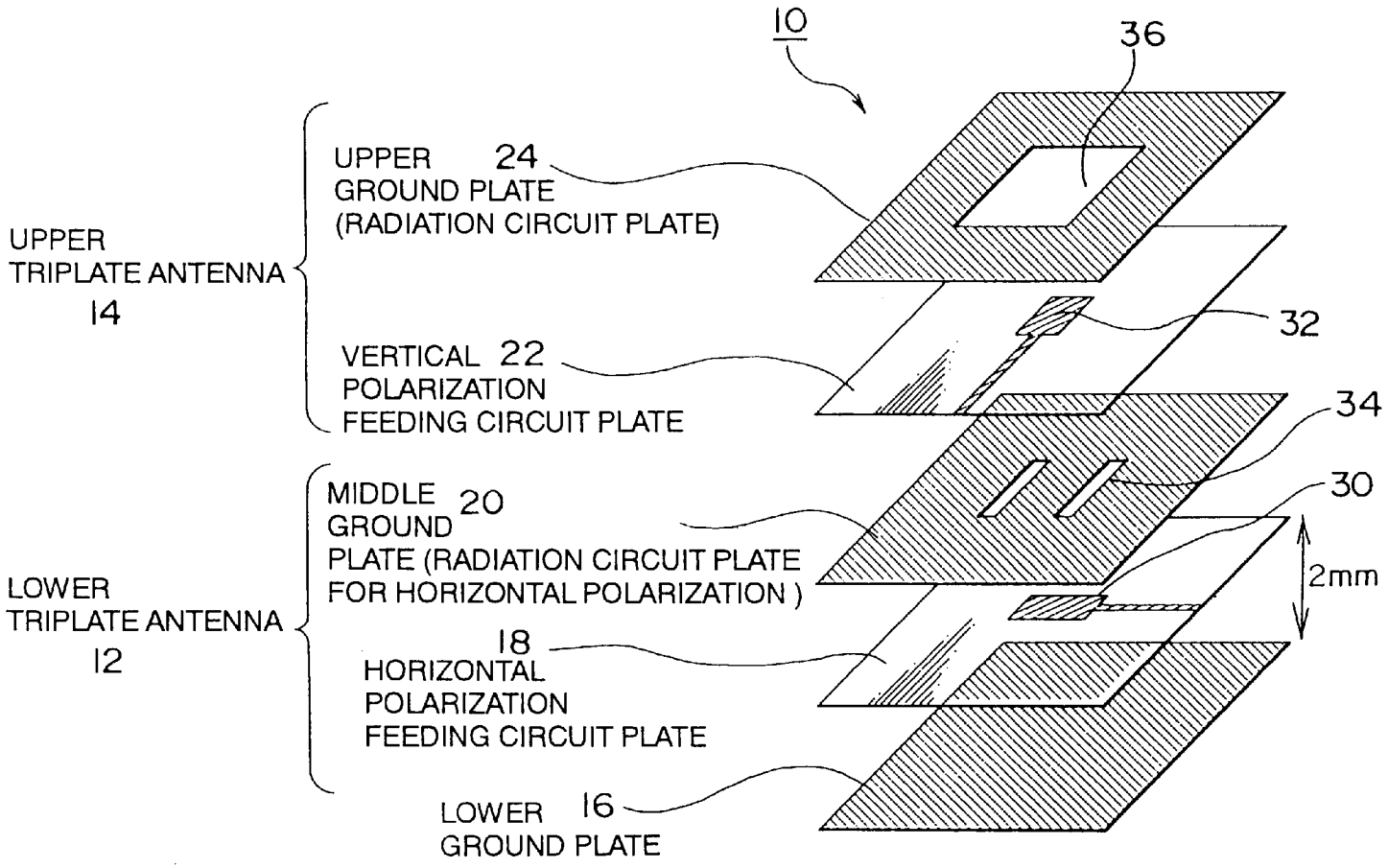
FIG. 3 shows an antenna element forming an antenna device of a preferred embodiment of the present invention.

FIG. 3 shows an antenna element 10 forming an antenna device. The antenna element 10 is constructed by stacking two triplate antennas 12 and 14 in an orthogonal direction. The lower antenna 12 receives a horizontal polarization, while the upper antenna 14 receives a vertical polarization. More specifically, the antenna element 10 includes stacked layers of a lower ground plate 16, a horizontal polarization feeding circuit plate 18, a middle ground plate (horizontal polarization radiation circuit plate) 20, a vertical polarization feeding circuit plate 22, and an upper ground plate (radiation circuit plate) 24. A dielectric layer having a thickness of about 2 mm is interposed between the plates for isolation. The horizontal and vertical polarization feeding circuit plates 18 and 20 have horizontal and vertical feeding probes 30 and 32, respectively. The middle ground plate 20 includes a coupling slot 34, and the upper ground plate 24 has a radiation window 36.

Figure 4B:
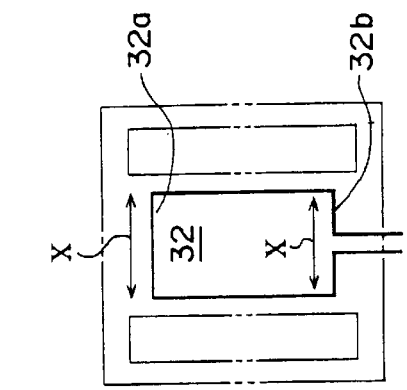
FIGS. 4A–4C are top views of the antenna element shown in FIG. 3.
Figure 4C:
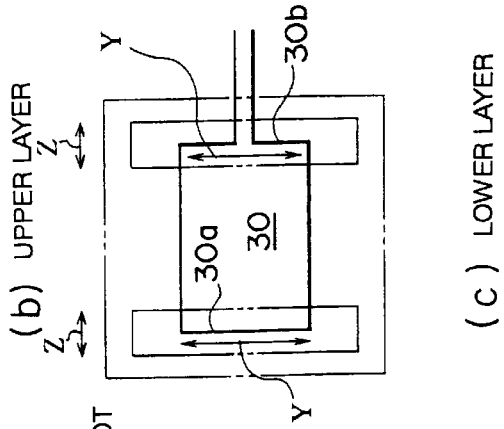
Figure 4A:
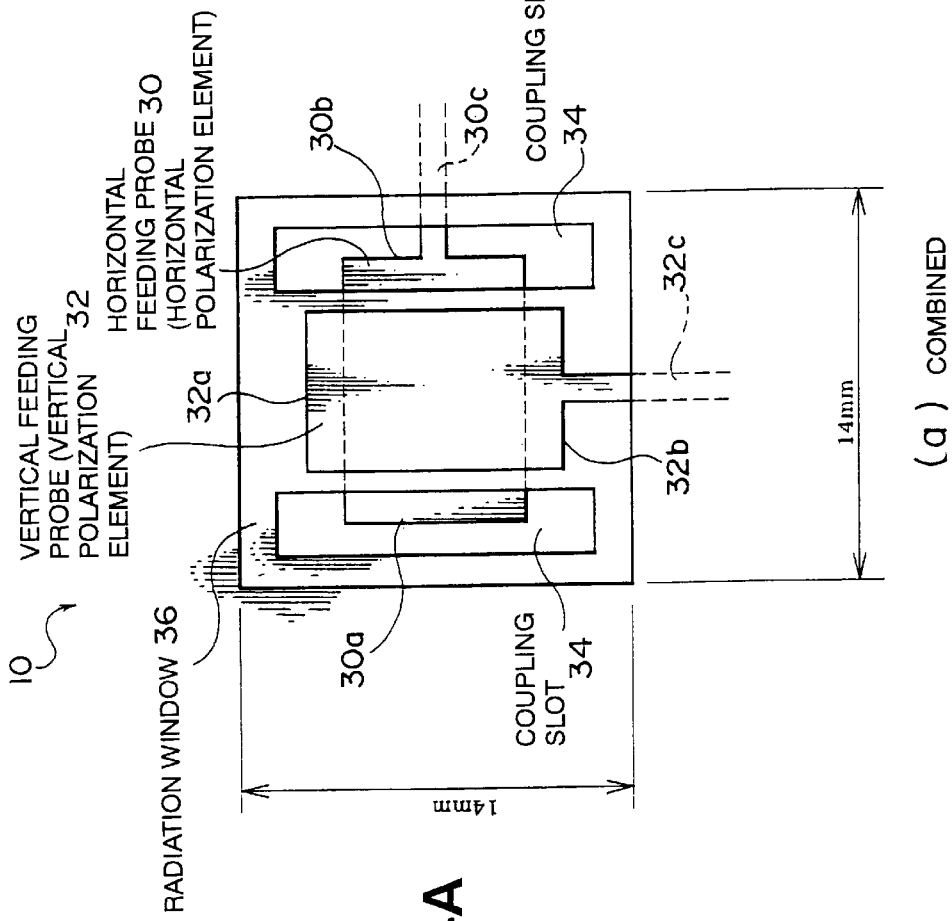

FIGS. 4A–4C are top views of the antenna element 10. The horizontal and vertical feeding probes provided perpendicularly to each other receive horizontally and vertically polarized signals, respectively. The longer sides of the twin coupling slots 34 cross perpendicularly to the horizontal feeding probe 30 in the lower antenna, to thereby gain electromagnetic coupling of the horizontal feeding probe 30, while the longer side of the coupling slot 34 runs parallel to the vertical feeding probe 32 of the upper antenna, and a metal portion is disposed on the bottom side of the vertical feeding probe 32. As a result, the middle plate 20 functions as a ground plate, and electromagnetic coupling in the upper antenna 14 can be ignored. Thus, the middle ground plate 20 serves as a radiation circuit for the lower antenna 12 and as a ground plate for the upper antenna 14. The radiation window 36 is a 14 mm×14 mm square aperture element for receiving a vertical polarization and transmitting a horizontal polarization through to the lower antenna 12.

The present embodiment is characterized in that the feeding probes 30 and 32 are provided as rectangular patches. As shown in FIGS. 4A and 4C, at its opposing ends in the polarization direction, the horizontal feeding probe 30 includes patch edges 30*a* and 30*b* crossing (perpendicularly) the polarization direction. An elongated feeding line 30*c* extends from the patch edge 30*b* and has a width so adjusted as to gain impedance matching. Similarly, as shown in FIGS. 4A and 4B, the vertical feeding probe 32 includes patch edges 32*a* and 32*b* crossing the polarization direction, and a feeding line 32*c* extending from the patch edge 32*b*.

By thus providing patch probes, magnetic current runs through the patch edge, so that the antenna element 10 serves as a magnetic current antenna. A vertical polarization is received by the vertical feeding probe 32 through the radiation window 36. In the patch edges 32*a* and 32*b*, in-phase magnetic current is generated in the direction of the arrow X.

Meanwhile, a horizontal polarization is transmitted through the radiation window 36 and the twin coupling slots 34 to reach the horizontal feeding probe 30, whereby in-phase magnetic current runs through patch edges 30*a* and 30*b* in the direction of the arrow Y in FIG. 4C. Electromagnetic waves transmitted through the slot 34, where an electric field is generated in the direction of its width (indicated by the arrow Z), give rise to magnetic current in patch edges 30*a* and 30*b*, resulting in standing waves between patch edges 30*a* and 30*b*. A phase match can be obtained between the opposing edges 30*a* and 30*b*, i.e. the twin slots 34, contributing to improvement in efficiency of a single antenna element.

The present embodiment is particularly suited to an application wherein reduction of the number of antenna elements is desired. In conventional antennas, the probe is not provided as a patch. Achieving a phase match between the slot pair in conventional antennas requires spacing of one wavelength between the slots. However, wavelength of CS broadcast, for example, exceeds 20 mm (about 24 mm in free space, and about 22 mm in the dielectric), and providing such a wide spacing for the slot pair is not practical. Although in conventional systems, effects of difference in phase are reduced by utilizing interaction between a multitude of elements in the array, the above-described difference in phase cannot be ignored if the number of antenna elements is to be reduced.

On the other hand, according to the present embodiment, a phase match can be obtained between the slots when only a small spacing is provided between the slots, leading to an enhanced efficiency of a single antenna element. Consequently, a high antenna efficiency can be achieved even when an antenna array is formed by a small number of elements. This is also advantageous for an application of a rectangular antenna array extending in a transverse direction described hereafter.

The present embodiment also offers an advantage that the antenna can function over a broader band because the probe element of a patch type is employed.

"Reduction of polarization angle loss"

Figure 5:
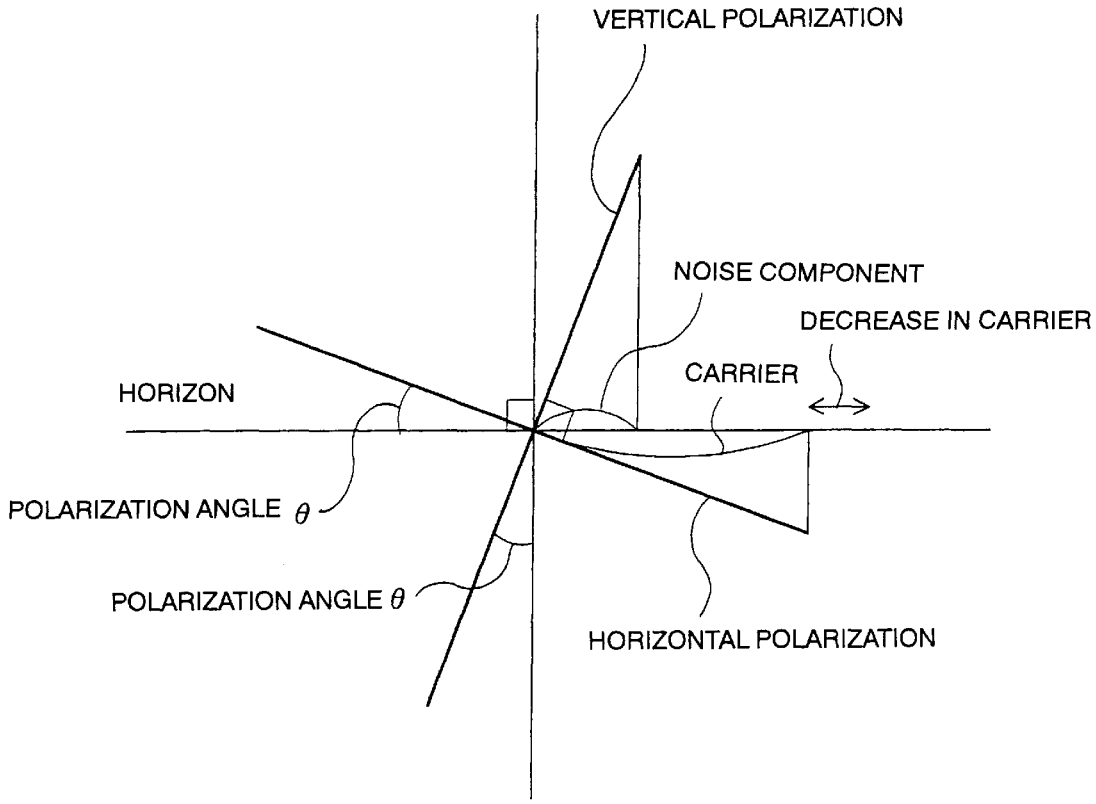
FIG. 5 illustrates definition of polarization angle, and polarization angle loss.

One aspect of the preferred embodiment can be better understood from the following illustrative example of a vehicle as a mobile unit provided with an antenna for receiving CS broadcast. CS satellites almost always orbit in geostationary paths located over the earth's equator. Due to the difference in latitude between the positions of the CS satellite (transmitting station) and the vehicle (receiving station), a horizontal polarization arrives with an inclination relative to the horizon, as shown in FIG. 5 (the same applies to a vertical polarization). The angle of this inclination is referred to as a polarization angle θ. Assuming that a horizontal polarization with the polarization angle θ is received by an antenna having a feeding probe disposed in parallel to the horizon, the carrier of the horizontal polarization is decreased and a noise component is generated by unintentionally receiving a vertical polarization as well. The resulting loss is referred to as polarization angle loss.

In a fixed receiving station, it is possible to initially set the direction of the antenna so as to avoid polarization angle loss because the polarization angle remains constant. However, in the case of a mobile unit, the relative position between the transmitting and receiving stations changes as the mobile unit moves, and therefore the polarization angle varies with a change in position.

Figure 6:
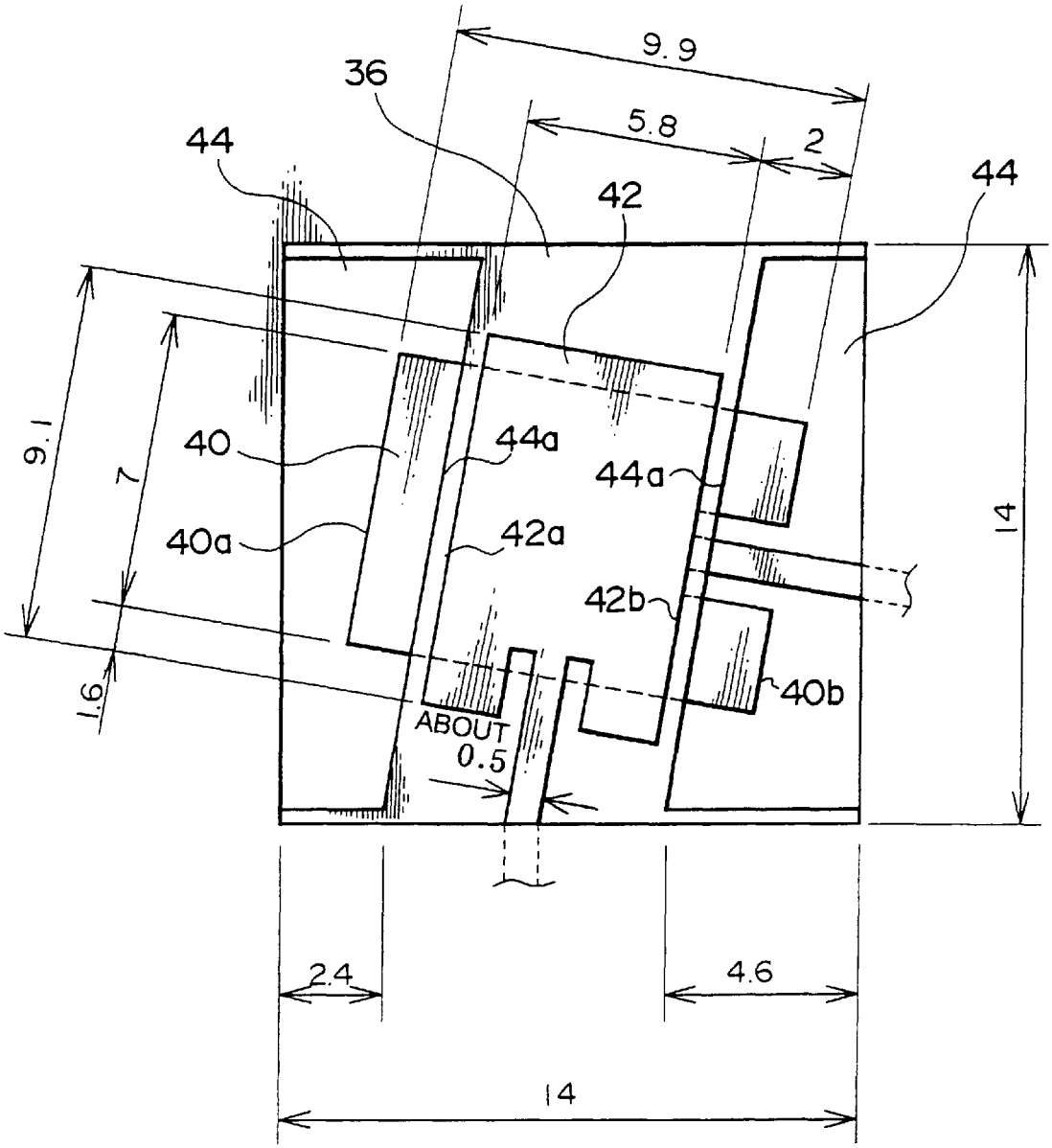
FIG. 6 shows an antenna element in which a feeding probe is inclined for the sake of reducing polarization angle loss.

Thus, referring to FIG. 6, as a characteristic feature of the present embodiment, horizontal and vertical feeding probes 40 and 42 (polarization planes) are so inclined as to face in the direction corresponding to a representative value of polarization angles in the vehicle's travelling area (the area in which the antenna is used). An example of the traveling area is the whole of Japan. The representative value of polarization angles can be the polarization angle at the central point of the traveling area in the east-west direction, the polarization angle at the point where the mobile units are concentrated most, the polarization angle at the point corresponding to the centroid of the map for the traveling area, or any other representative polarization angle. For the example shown in FIG. 6, the polarization angle at a certain point in the Kansai area of Japan is selected as a representative value, and the feeding probes 40 and 42 are disposed to be inclined at that angle. In this example the antenna element is mounted on a vehicle so that the transverse side of the radiation window 36 is horizontal.

While setting of the probe angle is described above in connection with a case of Japan as an example, the angle can be set similarly for other traveling areas or countries, such as the United States of America.

By thus orienting the probe in accordance with the representative value of polarization angles, the change of polarization angle in the traveling area can be absorbed. CS broadcast can be received under the condition where the polarization angle is relatively small no matter where in the traveling area the vehicle is located. As a result, the polarization angle loss can be suppressed as a whole, leading to improvement in performance of the antenna.

Further, as shown in FIG. 6, in addition to the feeding probes 40 and 42, the coupling slot 44 is also inclined at the same angle. Each inner side 44*a* of the slot is parallel to the patch edges 40*a* and 40*b* of the horizontal feeding probe 40, and to the longitudinal edges 42*a* and 42*b* of the vertical feeding probe 42.

If the inner side of the slot is not parallel to the patch edge, the direction of magnetic current on the patch edge does not coincide with that of the electric field in the slot. As a result, a cross polarization component is generated in the received waves, and therefore a vertical polarization is partially received by the lower antenna.

According to the present embodiment, generation of the cross polarization component discussed above can be avoided and a high ability to identify cross polarization can be obtained by providing the coupling slot 44 of the shape shown in FIG. 6.

"Array Antenna Device"

Figure 7:
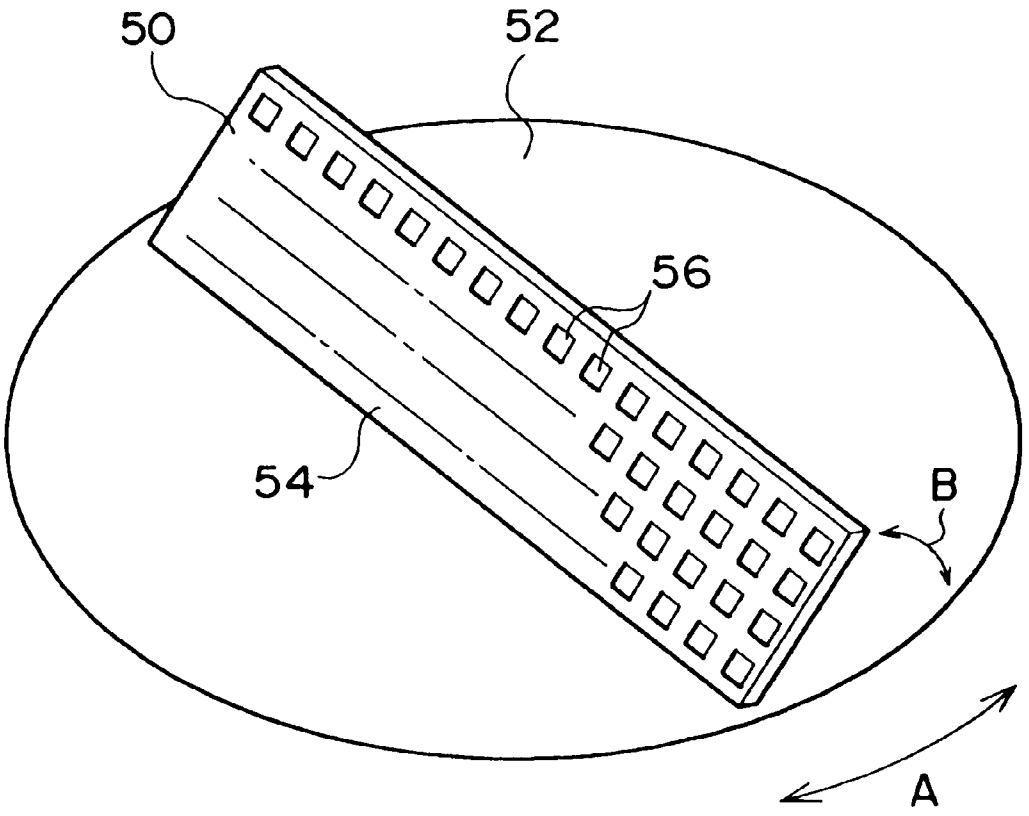
FIG. 7 is a perspective view showing an array antenna device.

FIG. 7 shows an array antenna device formed by the above-described antenna elements. An elongate array of elements extending in a transverse direction is formed by 64 antenna elements arranged in a 4×16 rectangular matrix. An antenna assembly 50 including the array of elements is mounted on a rotary table 52, which is rotated (as indicated by the arrow A) so that the element array faces in the direction of the CS satellite. The inclination angle of the antenna assembly 50 is also adjusted (as indicated by the arrow B) so that the element array faces the CS satellite (the satellite is positioned normal to the array). Alternatively to such mechanical change of the angle of the antenna assembly 50, beam direction can be adjusted according to principles of electronic scanning and phase control.

Figure 8A:
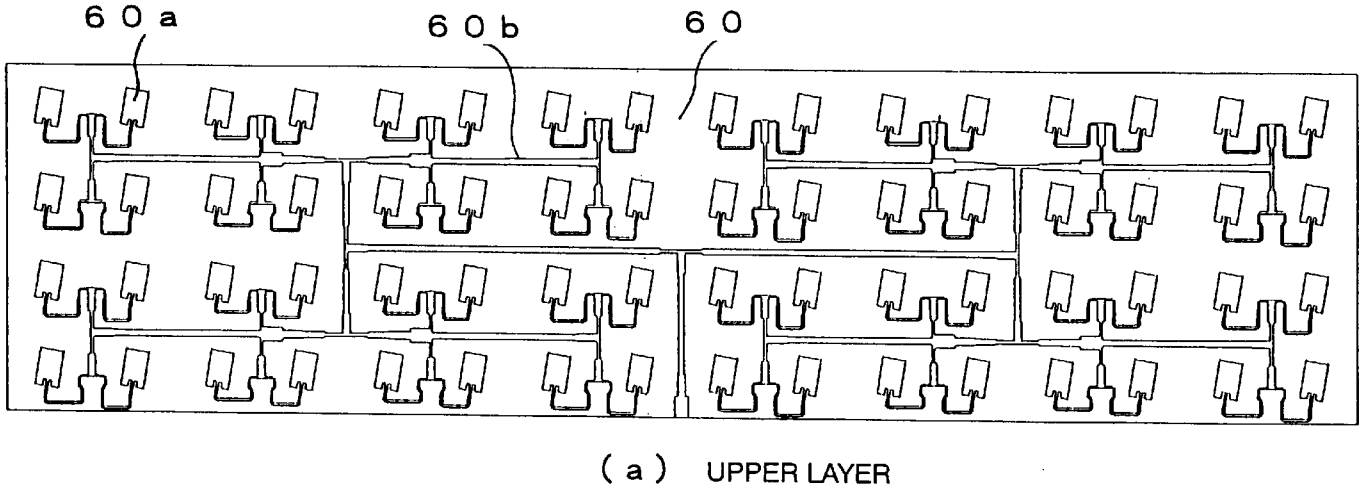
FIGS. 8A and 8B show a feeding circuit plate of the antenna in FIG. 7.
Figure 8B:
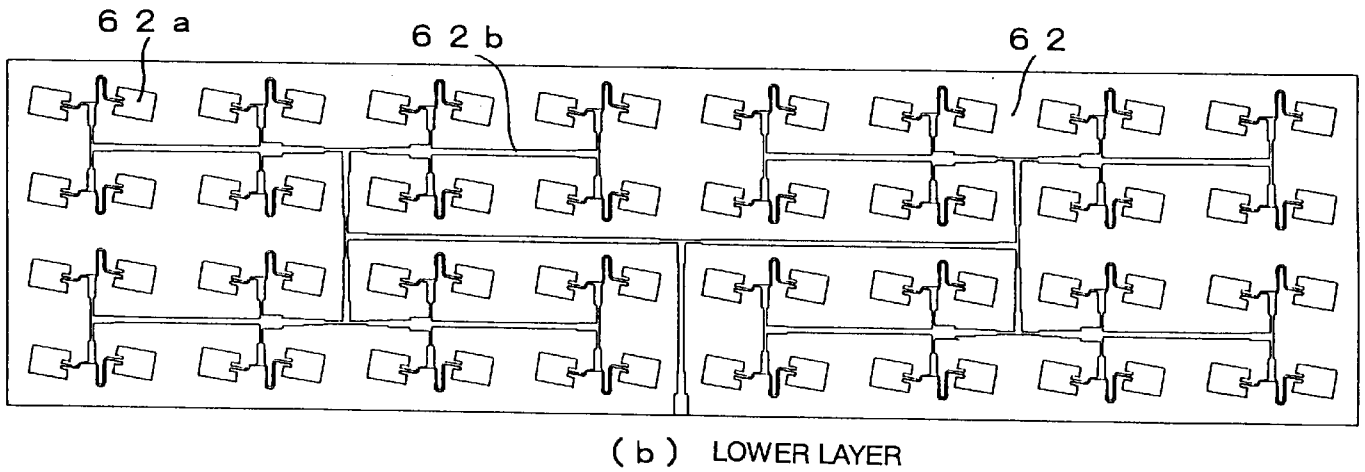

FIGS. 8A and 8B show upper and lower feeding circuit plates 60 and 62. Feeding probes 60*a* for receiving a vertical polarization are arranged for the upper layer, while feeding probes 62*a* for receiving a horizontal polarization are arranged for the lower layer. Feeding lines 60*b* and 62*b* are disposed in the gaps between the probes on the circuit plates 60 and 62, respectively. Although not shown in the figures, each ground plate is sized similarly to the circuit plates 60 and 62, and the coupling slots and the like are properly arranged.

(1) As described above, feeding probes 60*a* and 62*a* are inclined in accordance with the representative value of polarization angles, as is the coupling slot, not shown. It should be noted that, if the antenna element itself is inclined, the square radiation window of the upper ground plate is also inclined. This would lead to a considerable restriction on wiring space for feeding lines, whereby wiring of feeding lines 60*b* and 62*b* as shown in FIG. 8 would be difficult.

However, according to the present embodiment, the radiation windows 56 (square in shape) of the upper ground plate (radiation circuit plate) 54 are aligned in a lattice pattern without an inclination of the upper and lower sides of the window relative to the horizon (the transverse direction of the array), as shown in FIG. 7, even though the probe and the slot are inclined. Thus, space between the radiation windows 56 is kept for wiring, ensuring freedom of wiring.

(2) As another characteristic feature of this embodiment, the measures described hereafter are taken for efficiently utilizing the parallel plate mode. As described above, the parallel plate mode waves are electromagnetic waves propagating between the ground plates without contributing to radiation. By arranging a multitude of antenna elements in one direction and providing a spacing of one wavelength between the elements, electromagnetic waves in the parallel plate mode are radiated from other antenna elements and efficiently used, to thereby enhance the antenna efficiency. However, when a transversely elongate array as shown in FIG. 7 is employed in order to reduce the height, a number of elements required for fully utilizing the parallel plate mode cannot be arranged. Therefore, according to the present embodiment, the efficient use of the parallel plate mode is ensured as described below.

Figure 9:
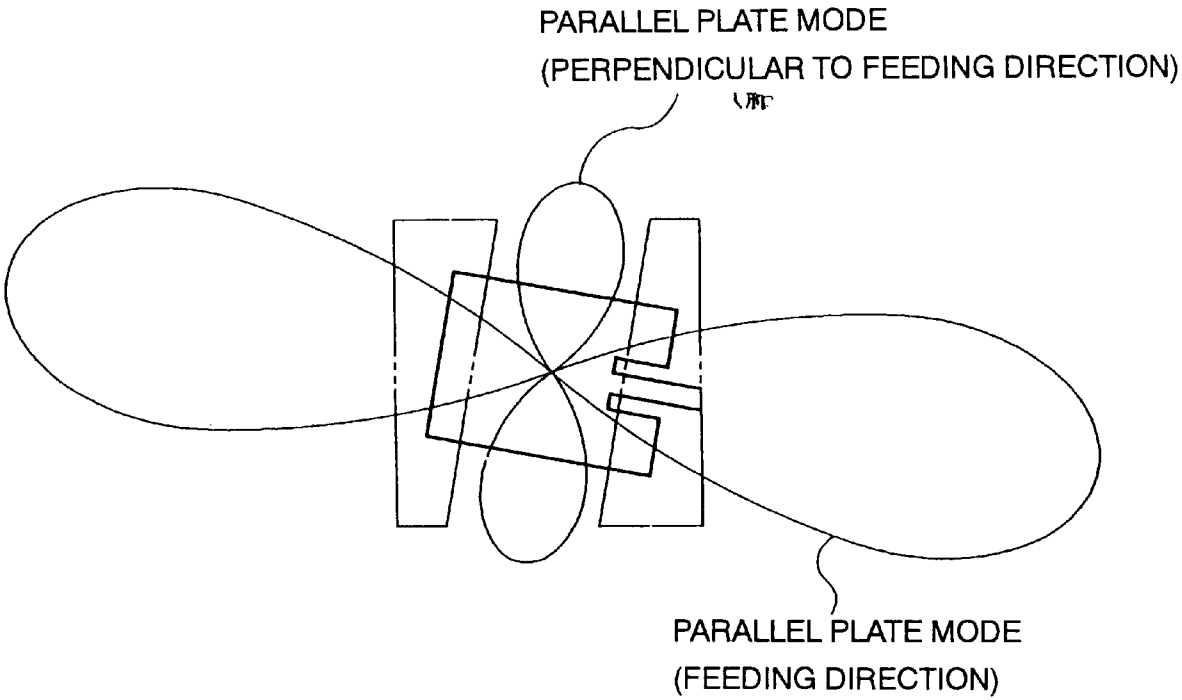
FIG. 9 illustrates propagating direction of parallel plate mode waves.

The parallel plate mode waves have an easily-propagating direction and a hardly-propagating direction. In a feeding probe of a patch type of the present embodiment, the main propagating direction coincides with the feeding direction as shown in FIG. 9 because the parallel plate mode tends to be generated in the feeding direction. Especially in the lower antenna, the parallel plate mode exhibits greater strength in the feeding direction because it is mainly generated in the disconnected slots.

Further, the parallel plate mode is generated more greatly in the lower antenna than in the upper antenna. In other words, the ratio of electromagnetic waves in the parallel plate mode is higher in the lower antenna. This is because apertures at the upper portion of the lower antenna are small and tend to confine electromagnetic radiation.

In view of the above, the feeding direction of the lower antenna (i.e. the propagating direction of the parallel plate mode waves) is matched with the extending direction (i.e. the transverse direction, or longer side) of the element array as shown in FIG. 8B according to the present embodiment. Therefore, the parallel plate mode generated in the lower antenna is efficiently radiated from other elements arranged in the propagating direction, to thereby ensure efficient use of the parallel plate mode in the lower antenna with a high generation ratio.

Although only four antenna elements are arranged in the propagating direction of the parallel plate mode in the upper antenna, sufficient antenna efficiency is secured because the upper antenna has a low generation ratio of the parallel plate mode.

As described above, according to the present embodiment, efficient use of the parallel plate mode is sufficiently ensured and a high efficiency antenna can be implemented even though an element array extending in a transverse direction is employed to reduce the number of elements in the longitudinal direction. By employing such a transversely extending array, an antenna device with a reduced height suitable for a mobile unit can be realized.

It should be noted that the shape of the array is not limited to a rectangular one as shown in FIG. 7 but can take any suitable shape, such as an ellipse.

A rectangular array having 16 elements in the transverse direction and 4 elements in the longitudinal direction shown in FIG. 7 was fabricated to test its antenna efficiency. Each antenna element had the size and shape shown in FIG. 6. The frequency band ranged from 12.25 to 12.75 GHz. With only a small number of elements in the longitudinal direction, antenna efficiency as high as 60% was obtained for both polarizations. The antenna efficiency is represented by directive gain or nondirectional ratio.

In addition, cross polarization identification ratio as high as 16 dB or more was obtained for the above antenna. The cross polarization identification ratio is a ratio of strength between the main polarization and the cross polarization.

As described above, according to the present invention, a phase match is obtained between the coupling slots of each antenna element by properly arranging the slots and the probes of a patch type. Consequently, efficiency of an individual antenna element can be enhanced, and a high antenna efficiency can be achieved even with one element or a small number of elements.

By properly setting the angle of the feeding probe, effects of the change in polarization angle in the traveling area of the mobile unit can be suppressed and polarization angle loss can be reduced as a whole.

The present invention also makes it possible to efficiently use the parallel plate mode and to secure a high antenna efficiency even with an elongate element array such as a rectangular array.

Thus, the present invention can provide a high efficiency antenna suitable for use in a mobile unit that meets the requirement of reduction in height and exerts its full performance at any place in a wide travelling area.

It is apparent that the present invention can be similarly applied to antennas for units other than mobile units within the technical scope of the invention. For example, the arrangement of the antenna element in which a coupling slot is disposed over a patch edge is similarly applied to an antenna of a fixed type, contributing to improvement in efficiency of the antenna element. Also, an array antenna extending in a longitudinal direction for efficiently utilizing the parallel plate mode can be provided for a domestic use. It will also be appreciated that the above-described antenna is not limited to a reception use but also employed for transmission, which is embraced in the technical scope of the present invention.

What is claimed is:

1. A dual polarized flat antenna device, comprising:

at least one antenna element formed by stacking upper and lower flat antennas used for polarizations in different directions, wherein each of said upper and lower flat antennas includes a feeding probe of a patch type having patch edges at opposing ends in the polarizing direction, and a pair of coupling slots for coupling said lower flat antenna with said upper flat antenna are provided over the opposing patch edges of said feeding probe of said lower flat antenna; and wherein a magnetic flow is generated in the edges at the opposing ends in the polarizing direction by electromagnetic waves penetrating through the slots, and a standing wave is generated between both patch edges with phases in the two slots coinciding.

2. The dual polarized flat antenna device recited in claim 1, wherein said feeding probe is disposed to face in a direction corresponding to a representative value of polarization angles in an area where said antenna device is used.

3. The dual polarized flat antenna device recited in claim 1, wherein a plurality of said antenna elements are disposed to form an element array having an extending direction, the extending direction of said element array coinciding with a propagating direction of a parallel plate mode waves at said lower flat antenna.

4. The dual polarized flat antenna device recited in claim 1, wherein each of said upper and lower flat antennas is a triplate antenna.

5. A dual polarized flat antenna device mounted on a mobile unit, comprising:

at least one antenna element formed by stacking upper and lower flat antennas used for polarization in different directions; wherein each of said upper and lower flat antennas includes a feeding probe of a patch type having patch edges at opposing ends in the polarizing direction, the probe being disposed to face in a direction corresponding to a representative value of polarization angles in a traveling area of the mobile unit, and a pair of coupling slots for coupling said lower flat antenna with said upper flat antenna are provided over the opposing patch edge of said feeding probe of said lower flat antenna, and wherein a magnetic flow is generated in the edges at the opposing side of the polarizing direction by electromagnetic waves penetrating through the slots, and a standing wave is generated between both patch edges with phases in the two slots coinciding.

6. The dual polarized flat antenna device recited in claim 5, wherein:

a plurality of said antenna elements are arranged to form an element array, an upper ground plate having a group of radiation windows corresponding to said element array is disposed, and the group of radiation windows are arranged in a lattice pattern without an inclination with respect to a direction in which said element array is arranged.

7. A dual polarized flat antenna device, comprising:

a plurality of antenna elements, wherein:

each of said antenna elements is formed by stacking upper and lower flat antennas used for polarizations in different directions, each of said upper and lower flat antennas including a feeding probe of a patch type having patch edges at opposing ends in the polarizing direction, and a pair of coupling slots for coupling said lower flat antenna with said upper flat antenna and provided over the opposing patch edges of said feeding probe of said lower flat antenna, wherein a magnetic flow is generated in the edges at the opposing ends in the polarizing direction by electromagnetic waves penetrating through the slots, and a standing wave is generated between both patch edges with phases in each of the pair of slots coinciding, said plurality of antenna elements are arranged to form an element array having an extending direction, and the extending direction of said element array coincides with a propagating direction of parallel plate mode waves at said lower flat antenna.

8. A dual polarized flat antenna device mounted as a mobile unit comprising:

at least one antenna element formed by stacking upper and lower flat antennas used for polarization in different directions; wherein each of said upper and lower flat antennas includes a feeding probe disposed to face in a direction corresponding to a representative volume of polarization angles in a traveling area of the mobile unit; and wherein a coupling slot for coupling said lower flat antenna with said upper flat antenna is disposed to be inclined at an angle corresponding to an angle at which said feeding probe is disposed.

9. A dual polarized flat antenna device, comprising:

a lower ground plate;

a lower feeding probe for a polarization in a first direction disposed over said lower ground plate and formed as a patch provided with patch edges at opposing ends in a polarization direction;

a middle ground plate disposed over said lower feeding probe and having a pair of coupling slots for coupling a lower antenna with an upper antenna, said pair of coupling slots disposed over the opposing patch edges of the lower feeding probe;

an upper feeding probe for a polarization in a second direction disposed on said middle ground plate; and an upper ground plate disposed over said upper feeding probe and having a radiation window for said upper and lower antennas.

10. A dual polarized flat antenna device, comprising:

at least one antenna element formed by stacking upper and lower flat antennas used for polarization in different directions, wherein each of said upper and lower flat antennas includes a feeding probe of a patch type having patch edges at opposing ends in the polarizing direction;

a pair of coupling slots for coupling said lower flat antenna with said upper flat antennas is provided over the opposing patch edges of said feeding probe of said lower flat antenna; and wherein at least one of said coupling slots is disposed to be inclined at an angle corresponding to an angle at which said feeding probe is disposed.

* * * * *